US010993600B2

(12) United States Patent
Kim et al.

(10) Patent No.: US 10,993,600 B2
(45) Date of Patent: May 4, 2021

(54) DISHWASHER

(71) Applicant: LG ELECTRONICS INC., Seoul (KR)

(72) Inventors: Sungsik Kim, Seoul (KR); Minchul Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 295 days.

(21) Appl. No.: 16/368,105

(22) Filed: Mar. 28, 2019

(65) Prior Publication Data

US 2019/0216288 A1 Jul. 18, 2019

Related U.S. Application Data

(62) Division of application No. 15/617,297, filed on Jun. 8, 2017, now Pat. No. 10,285,560.

(30) Foreign Application Priority Data

Jun. 10, 2016 (KR) ..... 10-2016-0072198

(51) Int. Cl.
*A47L 15/22* (2006.01)
*A47L 15/23* (2006.01)
(Continued)

(52) U.S. Cl.
CPC ..... *A47L 15/23* (2013.01); *A47L 15/4208* (2013.01); *A47L 15/4221* (2013.01);
(Continued)

(58) Field of Classification Search
CPC ..... A47L 15/22
See application file for complete search history.

(56) References Cited

U.S. PATENT DOCUMENTS

2012/0138110 A1 6/2012 Chen et al.
2013/0247944 A1 9/2013 Fischer et al.
2014/0246059 A1* 9/2014 Feddema ..... A47L 15/428 134/198

FOREIGN PATENT DOCUMENTS

DE 24 45 491 4/1976
DE 10 2006 06 11 01 6/2008

OTHER PUBLICATIONS

European Search Report dated Nov. 8, 2017 issued in Application No. 17174725.6.

* cited by examiner

*Primary Examiner* — Jason Y Ko
(74) *Attorney, Agent, or Firm* — KED & Associates LLP

(57) ABSTRACT

A dishwasher is provided that may include a tub configured to define a washing space in which a washing object is washed, the tub having an open side, a first accommodating rack configured to accommodate the washing object inside of the tub, the first accommodating rack being unloadable from the tub, and a door configured to selectively open and close the open side of the tub, the door supporting the first accommodating rack when the first accommodating rack is unloaded. The tub may include a first protrusion protruding from an inner sidewall of the tub toward the washing space so as to support the first accommodating rack and guide movement of the first accommodating rack, and a second protrusion provided above the first protrusion and protruding from the inner sidewall of the tub toward the washing space so as to prevent the first accommodating rack from being lifted upward when the first accommodating rack is unloaded.

12 Claims, 15 Drawing Sheets

(51) Int. Cl.
*A47L 15/42* (2006.01)
*A47L 15/50* (2006.01)

(52) U.S. Cl.
CPC ..... *A47L 15/4223* (2013.01); *A47L 15/4246* (2013.01); *A47L 15/4257* (2013.01); *A47L 15/507* (2013.01)

DISHWASHER

CROSS-REFERENCE TO RELATED APPLICATION

This application is a Divisional Application of prior U.S. patent application Ser. No. 15/617,297 filed Jun. 8, 2017, which claims priority under 35 U.S.C. § 119 to Korean Patent Application No. 10-2016-0072198, filed on Jun. 10, 2016, whose entire disclosures are hereby incorporated by reference.

BACKGROUND

1. Field

A dishwasher is disclosed herein.

2. Background

A dishwasher is an appliance that removes contaminants such as, for example, food residue, attached to, for example, dishes or cookware (hereinafter referred to as "washing objects") using a detergent and wash water. Such a dishwasher generally may include a tub defining a washing space, an accommodating unit or rack configured to accommodate the washing object inside the tub, a spray arm configured to spray wash water to the accommodating unit, a sump configured to store the wash water therein, and a supply flow path configured to supply the wash water stored in the sump to the spray arm.

A user may completely open a door of the dishwasher and pull the accommodating unit out in order to unload the accommodating unit. A rail may be formed on an upper surface of the door so as to guide movement of the accommodating unit. However, when the user pulls the accommodating unit obliquely, the accommodating unit may be derailed, and may not be smoothly unloaded.

BRIEF DESCRIPTION OF THE DRAWINGS

The embodiments will be described in detail with reference to the following drawings in which like reference numerals refer to like elements wherein.

DETAILED DESCRIPTION

Figure 1:
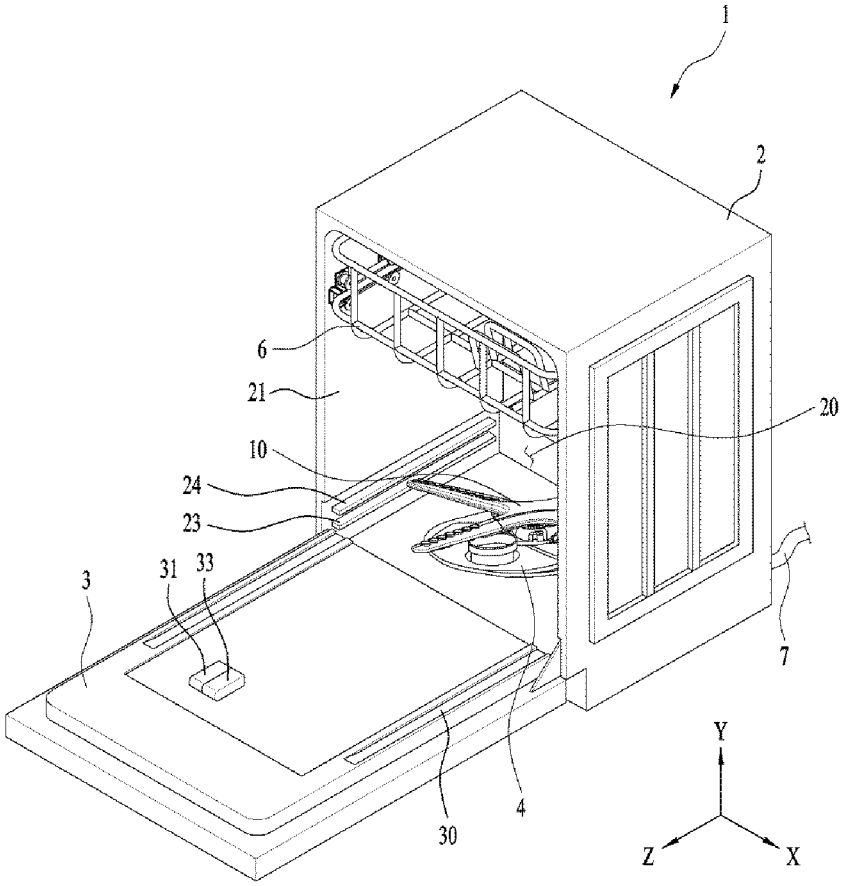
FIG. 1 is a perspective view illustrating a dishwasher according to an embodiment.

Hereinafter, embodiments will be described with reference to the accompanying drawings. Meanwhile, descriptions related to specific structures and functions are merely given in order to describe the embodiments, but are not intended to limit the embodiments to the disclosed specific forms, and should be understood to include all modifications, equivalents, and substitutions, which are included in the spirit and scope. In addition, the same reference numerals are given to the same constituent elements in the drawings, and a repeated description of the same constituent elements will be omitted.

Figure 2:
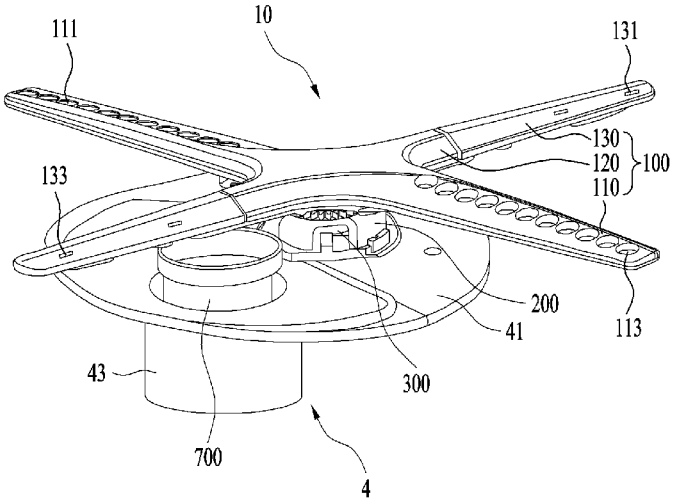
FIG. 2 is a perspective view illustrating a sump and a lower spray arm assembly of FIG. 1 according to an embodiment.
Figure 3:
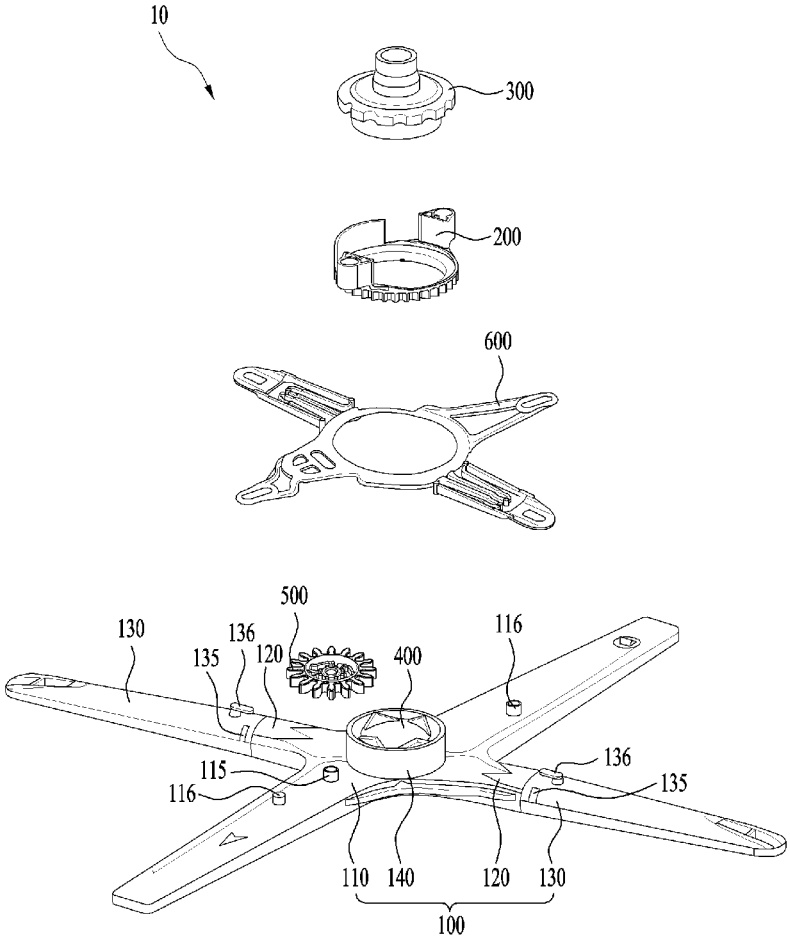
FIG. 3 is an exploded perspective view illustrating the lower spray arm assembly of FIG. 2 according to an embodiment.
Figure 4:
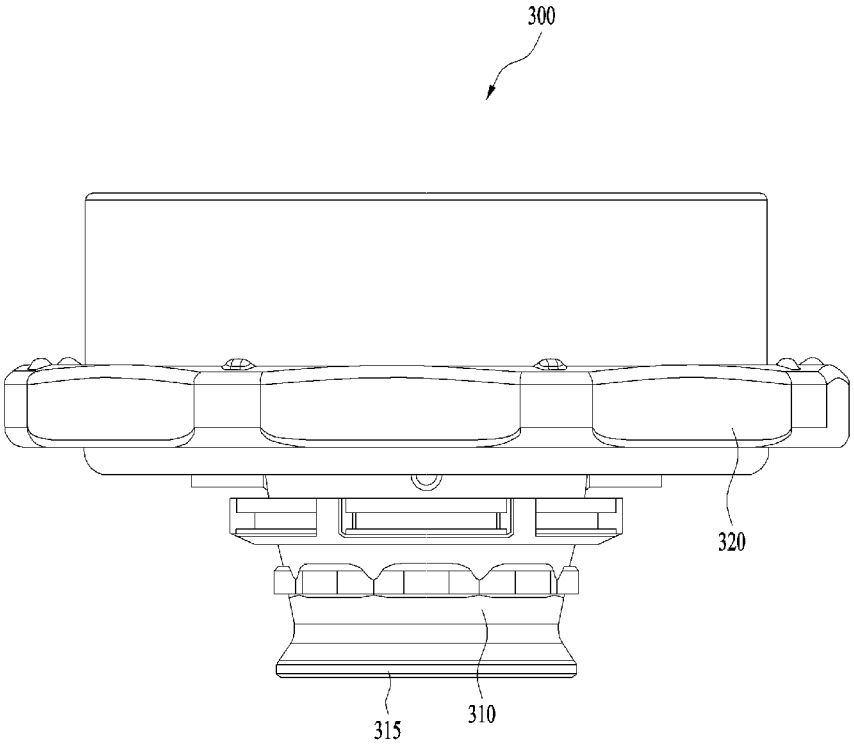
FIG. 4 is a side view illustrating an arm holder of FIG. 3 according to an embodiment.
Figure 5:
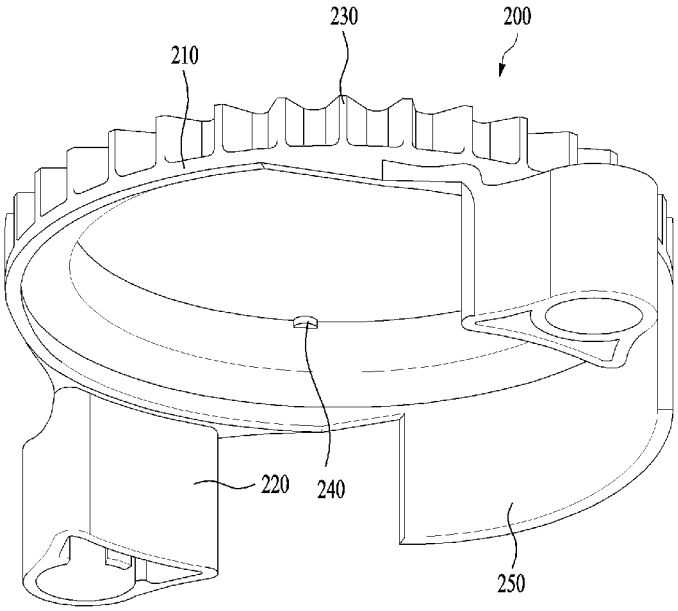
FIG. 5 illustrates a fixed gear unit of FIG. 3 according to an embodiment.
Figure 6:
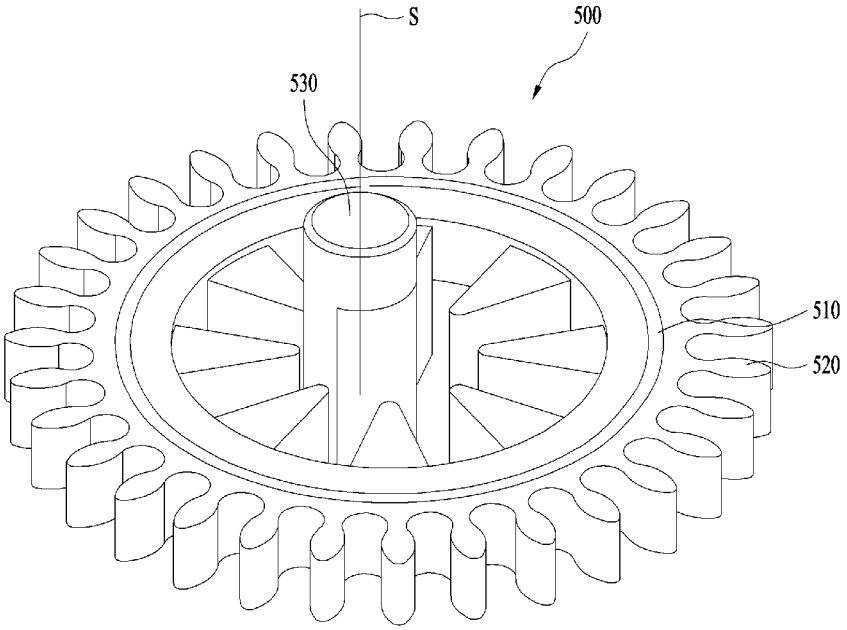
FIG. 6 is a perspective view illustrating an eccentric rotation gear of FIG. 3 according to an embodiment.
Figure 7:
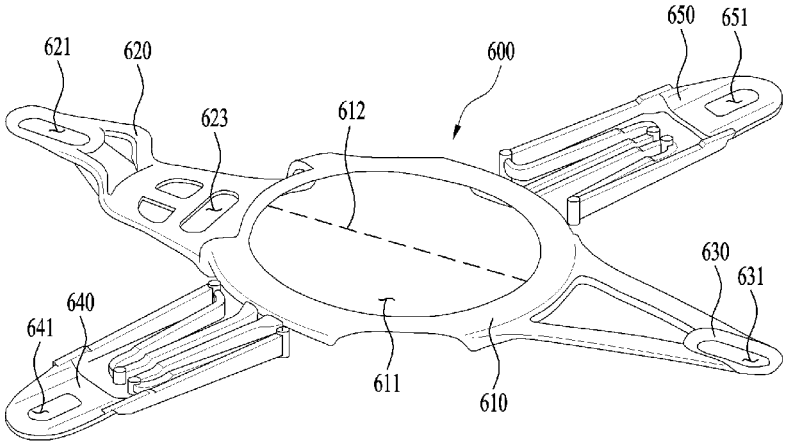
FIG. 7 is a perspective view illustrating a link member of FIG. 3 according to an embodiment.

FIG. 1 is a perspective view illustrating a dishwasher according to an embodiment. FIG. 2 is a perspective view illustrating a sump and a lower spray arm assembly of FIG. 1 according to an embodiment. FIG. 3 is an exploded perspective view illustrating the lower spray arm assembly of FIG. 2 according to an embodiment. FIG. 4 is a side view illustrating an arm holder of FIG. 3 according to an embodiment. FIG. 5 is a view illustrating a fixed gear unit of FIG. 3 according to an embodiment. FIG. 6 is a perspective view illustrating an eccentric rotation unit of FIG. 3 according to an embodiment. FIG. 7 is a perspective view illustrating a link member of FIG. 3 according to an embodiment.

Referring to FIGS. 1 to 7, a dishwasher 1 according to an embodiment may include a tub 2 defining a washing space 20, a door 3 configured to selectively open and close the washing space 20, a sump 4 provided inside of the tub 2 to store wash water therein, at least one accommodating unit or rack 5, 6 provided inside of the tub 2 to accommodate a washing object therein, and a lower spray arm assembly 10 configured to spray wash water toward the washing object accommodated in the accommodating unit 5, 6. The tub 2 may define an external appearance of the dishwasher 1 and may also define therein the washing space 20, in which the washing object may be accommodated. One side of the tub 2 may be opened, and the open side may be selectively opened and closed by the door 3.

The door 3 may selectively open and close the washing space 20, and may support the accommodating unit 5, 6 when the accommodating unit 5, 6 is unloaded. In addition, for example, a detergent box 31 and a rinsing-agent box 33 may be provided on an inner surface of the door 3. The detergent box 31 and the rinsing-agent box 33 may store a detergent and a rinsing agent respectively, and may supply the same in the tub 2.

For example, the detergent may be supplied into the tub 2 in a washing operation, thereby increasing an effect of removing foreign substances. The rinsing agent may be supplied into the tub 2 and sprayed onto the washing object. The rinsing agent may assist in sterilization and disinfection of the washing object. The rinsing agent may weaken a surface tension of water adhered on a surface of the washing object so as to allow the water to easily flow down, which may reduce a time taken for the washing object to dry.

The sump 4 may receive and store water from outside via a water supply unit (or water supply) 7 and may circulate the water inside of the dishwasher 1. Specifically, the water stored in the sump 4 may be sprayed toward the accommodating unit 5,6 and the washing object via the lower spray arm assembly 10. The sprayed water may fall to a bottom of the washing space 20 and may pass through a sump cover 41 and a sump discharge portion or tube 43 to thereby be recollected in the sump 4.

At least one accommodating unit may accommodate the washing object inside of the tub 2. For example, the accommodating unit may include a first accommodating unit or rack 5 (see FIG. 9) and a second accommodating unit or rack 6 provided above the first accommodating unit 5. The first and second accommodating units 5 and 6 may be pulled outward through the opened side of the tub 2. The user may unload the respective accommodating units pulled outward by putting the washing object thereinto or removing the washing object which has been completely washed.

The first accommodating unit 5 may be pulled outward along protrusions 23 and 24 formed on an inner sidewall 21 of the tub 2, and may move along a door rail 30 formed on the inner surface of the door 3 after being removed from the tub 2. This will be described hereinafter with reference to FIGS. 9 to 11.

The lower spray arm assembly 10 may be mounted on the sump cover 41, and may spray wash water toward the washing object accommodated in the accommodating unit 5. In this embodiment, the lower spray arm assembly 10 may include a spray arm 100, which sprays wash water, a fixed gear unit (or fixed gear) 200 mounted on the sump cover 41 to rotatably support the spray arm 100, an arm holder 300 provided under the spray arm 100 and rotatably mounted on the sump cover 41, a flow-path switching unit or valve 400 accommodated inside of the arm holder 300 to switch the flow path of the wash water to be supplied to the spray arm 100, an eccentric rotational unit or gear 500 rotatably mounted to or on a lower surface of the spray arm 100 and engaged with the fixed gear unit 200, and a link member or bracket 600 connected to each of the spray arm 100, the fixed gear unit 200, and the eccentric rotational unit 500.

The spray arm 100 may include a main arm 110 rotatably provided inside of the tub 2, an auxiliary arm 130 separably mounted to or on the main arm 110, an extension 120 extending from the main arm 110 so as to be coupled to the auxiliary arm 120, and an arm holder coupling portion (or arm holder coupler) 140 in which at least a portion of the arm holder 300 may be accommodated. Although FIGS. 2 and 3 illustrate the spray arm 100 having two main arms 110 and two auxiliary arms 130, the embodiments are not limited thereto.

For example, the spray arm 100 may include the main arm 110 and the auxiliary arm 130, each of which may be provided in a number of three or more. Hereinafter, for convenience of description, only the case where the spray arm 100 includes two main arms 110 and two auxiliary arms 130 will be described.

The main arms 110 may receive wash water supplied from the sump 4 and spray the wash water toward the washing object. Although not illustrated, the main arms 110 may include multiple main flow paths therein, and may spray the wash water through spray holes 111 and 113 formed in an upper surface thereof. The wash water may be sprayed by water pressure generated in the main flow paths, without a separate power source.

A position, shape, and number of the spray holes 111 and 113 may be appropriately selected as needed. For example, when the position and shape of the spray holes 111 and 113 are combined in various ways, a direction in which the wash water is sprayed may be diversified. Accordingly, an area in which the wash water is sprayed may be increased, and a washing capability of the dishwasher 1 may be increased.

In this embodiment, the wash water may be sprayed in a direction that forms a predetermined angle relative to a direction perpendicular to an upper surface of the main arm 110. In other words, the direction in which the wash water is sprayed from the spray holes 111 and 113 may not be perpendicular to the upper surface of the main arm 110. In this case, the main arm 110 may be rotated by a reaction force due to the spraying of wash water. The main arm 110 may thus be rotated using only a spray pressure of wash water without a separate drive device, and a rotational direction and rotational speed of the main arm 110 may be determined by the spray direction and spray pressure of wash water.

One of the main arms 110 may include a gear rotational shaft 115 on a lower surface thereof, which is coupled to the eccentric rotational unit 500, and the respective main arms 110 may include guide bosses 116 on the lower surface thereof, which guide movement of the link member 600. The gear rotational shaft 115 may serve as a rotational shaft of the eccentric rotational unit 500. The guide bosses 116 may be provided in a same number as the number of main arms 110 and may be coupled to coupling portions or holes 641 and 651 of the link member 600. This will be described hereinafter. The arm holder coupling portion 140 may be provided on the lower surface of the main arms 110 and may accommodate at least a portion of the arm holder 300.

The extensions 120 may extend from the main arms 110 in radial directions so as to be coupled to the auxiliary arms 130. Thus, the extensions 120 may be provided in a same number as the number of auxiliary arms 130. Transfer flow paths, which are connected to the main flow paths in the main arm 110, may be formed in the extensions 120. The wash water supplied from the sump 4 may sequentially pass through the main flow paths and the transfer flow paths to thereby be supplied to the auxiliary arms 130.

The auxiliary arms 130 may be separably mounted to the respective extensions 120, and may have multiple spray holes 131 and 133 formed in an upper surface thereof for spraying the wash water. In addition, auxiliary flow paths, through which the wash water passes, may be provided in the auxiliary arms 130. The wash water supplied from the sump 4 may sequentially pass through the main flow paths, the transfer flow paths, the auxiliary flow paths, and the spray holes 131 and 133 to thereby be sprayed toward the washing object.

A position, shape, and number of the spray holes 131 and 133 may be appropriately selected as needed. For example, when the position and shape of the spray holes 131 and 133 are combined in various ways, the direction in which the wash water is sprayed may be diversified. Accordingly, an area in which the wash water is sprayed may be increased, and the washing capability of the dishwasher 1 may be increased. In this embodiment, each auxiliary arm 130 may have a discharge hole 135 formed in an outer circumferential surface thereof to discharge foreign substances.

When foreign substances are introduced into the auxiliary arms 130, the spray holes 131 and 133 in the auxiliary arms 130 may become clogged, or the auxiliary arms 130 may not rotate smoothly. Since this may directly cause deterioration in the washing capability of the dishwasher, it is necessary to remove the foreign substances. The discharge hole 135 may be formed close to the main arm 110, thereby enabling the removal of foreign substances introduced into the auxiliary arm 130. In particular, when the discharge hole 135 is provided in or on a side surface or lower surface of the auxiliary arm 130, the foreign substances may be more easily discharged outward.

In this embodiment, the auxiliary arm 130 may be manufactured using a material different from a material of the main arm 110. This may increase a strength of the auxiliary arm 130, which may continuously perform a rotational reciprocating motion, so as to prevent abrasion thereof. For example, the main arm may be formed using, for example, a synthetic resin, and the auxiliary arm may be formed using, for example, aluminum or stainless steel. In this case, the entire auxiliary arm 130 may be formed of a material different from a material of the main arm 110, or only a portion of the auxiliary arm 130 may be formed of a material different from a material of the main arm 110.

As exemplarily illustrated in FIG. 4, the arm holder 300 may include an inlet portion (or inlet) 310 rotatably coupled to the sump cover 41, a separation preventing portion or lip 315, which prevents the arm holder 300 from being separated from the sump cover 41, and a coupling portion (or coupler) 320 coupled to the spray arm 100. The arm holder 300 may rotate along with the spray arm 100 on the sump cover 41. In addition, the wash water supplied from the sump 4 may be supplied to the spray arm 100 after passing through an inside of the arm holder 300.

The flow path switching unit 400 may be accommodated inside of the arm holder 300. The flow path switching unit 400 may move upward when the wash water is introduced into the arm holder 300, and may move downward when the introduction of wash water stops. Through the movement of the flow path switching unit 400, the direction in which the wash water is supplied to the spray arm 100 may be varied.

The fixed gear unit 200 may be mounted on a top of the sump cover 41 so as to surround an outer circumferential surface of the arm holder coupling portion 140. The fixed gear unit 200 may be fixed to the sump cover 41 via a fastening member, and thus may not rotate.

As illustrated in FIG. 5, the fixed gear unit 200 may include a rim portion (or rim) 210 provided with multiple first gear teeth 230 and a support portion (or support) 220 extending downward from the rim portion 210 so as to be fixed on the sump cover 41. The rim portion 210 may have a hollow ring shape so that the arm holder coupling portion 140 may be accommodated in the hollow rim portion 210. At least one gap-reduction boss 240 may be provided on an inner circumferential surface of the rim portion 210 in order to reduce a gap between the rim portion 210 and the arm holder coupling portion 140. In this embodiment, the fixed gear unit 200 may further include a hand-jam-preventing portion or guard 250 extending downward from the rim portion 210.

As illustrated in FIG. 2, a filter unit (or filter) 700 may be installed to or on the sump cover 41 in order to filter foreign substances. The filter unit 700 may be unloaded upward through the space between the main arm 110 and the auxiliary arm 130. During unloading, a user's hand may become jammed inside of the fixed gear unit 200. The hand-jam-preventing portion 250 may prevent the user's hand from being jammed inside of a drive unit or drive such as, for example, the fixed gear unit 200 while replacing the filter unit 700, thereby reducing the possibility of an accident. In addition, the hand-jam-preventing portion 250 may prevent foreign substances removed from the washing object from being introduced into the drive unit.

The eccentric rotational unit 500 may be rotatably mounted on the lower surface of the spray arm 100 and may be engaged with the first gear teeth 230 of the fixed gear unit 200. The eccentric rotational unit 500 may include a rim portion (or rim) 510 coupled to the gear rotational shaft 115 on the lower surface of the main arm 110, multiple second gear teeth 520 formed on an outer circumferential surface of the rim portion 510, and an eccentric boss 530 protruding from the rim portion 510.

The eccentric rotation unit 500 may rotate when the main arm 110 rotates since the rim portion 510 is rotatably coupled to the gear rotational shaft 115. The eccentric rotational unit 500 may also circularly move along a periphery of the fixed gear unit 200 since the second gear teeth 520 on the outer circumferential surface of the rim portion 510 are engaged with the first gear teeth 230 of the fixed gear unit 200. In other words, when the main arm 110 rotates, the eccentric rotational unit 500 may spin in place while circularly moving along the periphery of the fixed gear unit 200. In this embodiment, a number of first gear teeth 230 and a number of second gear teeth 520 may be co-prime integers.

When the number of first gear teeth 230 and the number of second gear teeth 520 are multiples, a contact region of the first gear teeth 230 and the second gear teeth 520 may always be constant, and therefore, friction between the gear teeth 230 and 520 may worsen. In addition, a rotational angle of the auxiliary arm 130 is always constant regardless of a rotational position of the main arm 110, and therefore, wash water may have a constant spray pattern. When the spray pattern of wash water is constant, a range within which the wash water is sprayed is consequently limited, which may cause deterioration in the washing capability of the dishwasher 1. Accordingly, when the number of first gear teeth 230 and the number of second gear teeth 520 are co-prime integers, the friction between the gear teeth 230 and 520 may be reduced and the spray pattern of the wash water may be further diversified.

The link member 600 may include a rim portion (or rim) 610 having an insertion hole 611 and multiple extensions 620, 630, 640 and 650 extending from the rim portion 610 in radial directions. The link member 600 may be connected to both the spray arm 100 and the eccentric rotational unit 500. Specifically, the arm holder coupling portion 140 of the spray arm 100 may be inserted into the insertion hole 611, and the extensions 620, 630, 640 and 650 may be respectively coupled to the main arms 110 and the auxiliary arms 130.

Guide portions or slots 621 and 631 of the first and second extensions 620 and 630 may be respectively coupled to the guide bosses 116 of the main arms 110, and the coupling portions 641 and 651 of the third and fourth extensions 640 and 650 may be respectively coupled to power transmission portions or tabs 136 of the auxiliary arms 130. The first extension 620 may further have an insertion portion or hole 623, into which the eccentric boss 530 of the eccentric rotational unit 500 is inserted. The insertion portion 623 may extend in a direction substantially perpendicular to a direction in which the first extension 620 extends.

A torque of the eccentric rotational unit 500 may be converted into a rectilinear reciprocating motion of the link member 600, and the link member 600 may cause the auxiliary arm 130 to rotate. The expression "the auxiliary arm 130 rotates" means that the auxiliary arm 130 performs a rotational reciprocating motion within a predetermined angular range about a rotation axis corresponding to the direction in which the auxiliary arm 130 extends. The angle at which wash water is sprayed by the auxiliary arm 130 may continuously vary, and the spray range of wash water may be diversified. Thereby, the washing capability of the dishwasher 1 may be increased.

Hereinafter, the rolling of the auxiliary arm 130 will be described in more detail with reference to FIGS. 8A to 8D.

FIGS. 8A to 8D are views illustrating a procedure of rolling the auxiliary arm by the link member 600 according to an embodiment. FIGS. 8A to 8D illustrate the lower surface of the lower spray arm assembly 10 when the eccentric rotational unit 500 rotates by 0°, 90°, 180° and 270° respectively.

Figure 8A:
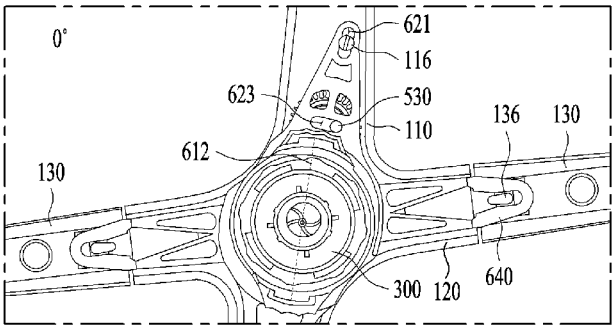
FIGS. 8A to 8D are views illustrating a procedure of rotating an auxiliary arm by the link member.
Figure 8B:
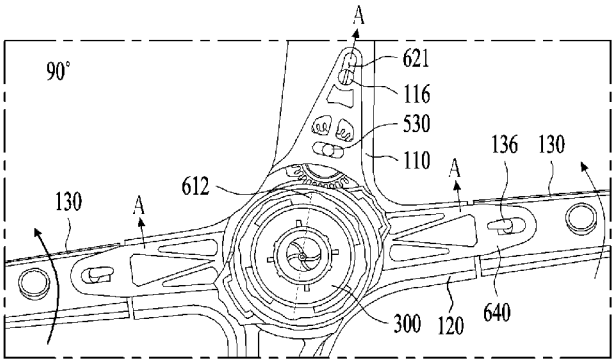

First, referring to FIG. 8A, in an initial state in which the eccentric rotational unit 500 does not rotate, the eccentric boss 530 may be located toward one side of the insertion portion 623 and the auxiliary arm 130 may be oriented parallel to the main arm 110. FIG. 8B illustrates a state in which the main arm 110 rotates by 90° clockwise. When the main arm 110 rotates clockwise, the eccentric rotational unit 500 engaged with the fixed gear unit 200 may rotate counterclockwise. Thereby, the eccentric boss 530 of the eccentric rotational unit 500 may apply pressure to the link member 600 in a direction A of the major axis 612.

Since the guide boss 116 is movable in the direction A within the guide portion 621, the link member 600 may move in the direction indicated by the arrow A. Through the movement of the link member 600, the power transmission portions 136 of the auxiliary arms 130 connected to the third and fourth extensions 640 and 650 may receive a force in the direction A, and the auxiliary arms 130 may rotate clockwise by a predetermined angle.

Figure 8C:
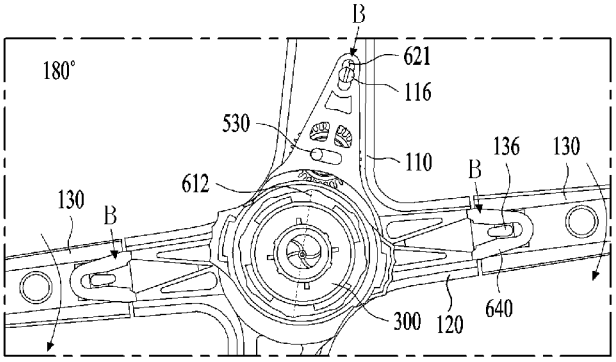

As illustrated in FIG. 8C, when the main arm 110 continuously rotates clockwise and the rotational angle thereof becomes 180° relative to the initial state (FIG. 8A), the eccentric rotational unit 500 may rotate counterclockwise by 180° relative to the initial state (FIG. 8A). In this case, the eccentric boss 530 may apply pressure to the link member 600 in a direction B of the major axis 612, and the link member 600 may move in the direction B to thereby return to the position illustrated in FIG. 8A. Since the power transmission portion 136 of the auxiliary arm 130 may receive force in the direction B, the auxiliary arm 130 may rotate counterclockwise by a predetermined angle to thereby return to the initial position illustrated in FIG. 8A.

Figure 8D:
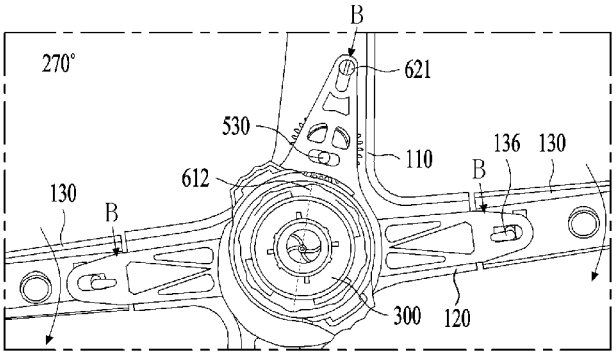

As illustrated in FIG. 8D, when the main arm 110 continuously rotates clockwise and the rotational angle thereof reaches 270° relative to the initial state (FIG. 8A), the eccentric rotational unit 500 may rotate counterclockwise by 270° relative to the initial state (FIG. 8A).

In this case, the eccentric boss 530 may apply pressure to the link member 600 in the direction B of the major axis 612, and the link member 600 may move in the direction B. Thereby, the power transmission portion 136 of the auxiliary arm 130 may receive a force in the direction B, and the auxiliary arm 130 may rotate counterclockwise by a predetermined angle.

Thereafter, when the main arm 110 rotates further clockwise, the link member 600 may again move in the direction A to thereby return to the state illustrated in FIG. 8A. At this time, the auxiliary arm 130 may rotate clockwise to thereby return to the position illustrated in FIG. 8A.

As described above, the eccentric rotational unit 500 may convert the rotation of the main arm 110 into the rectilinear reciprocating motion of the link member 600, and the auxiliary arm 130 connected to the link member 600 may perform rotational reciprocating motion (rolling) within a predetermined angular range about the rotation axis corresponding to the direction in which the auxiliary arm 130 extends.

Hereinafter, the structure of the accommodating units 5 and 6 will be described with reference to FIGS. 9 and 10.

Figure 9:
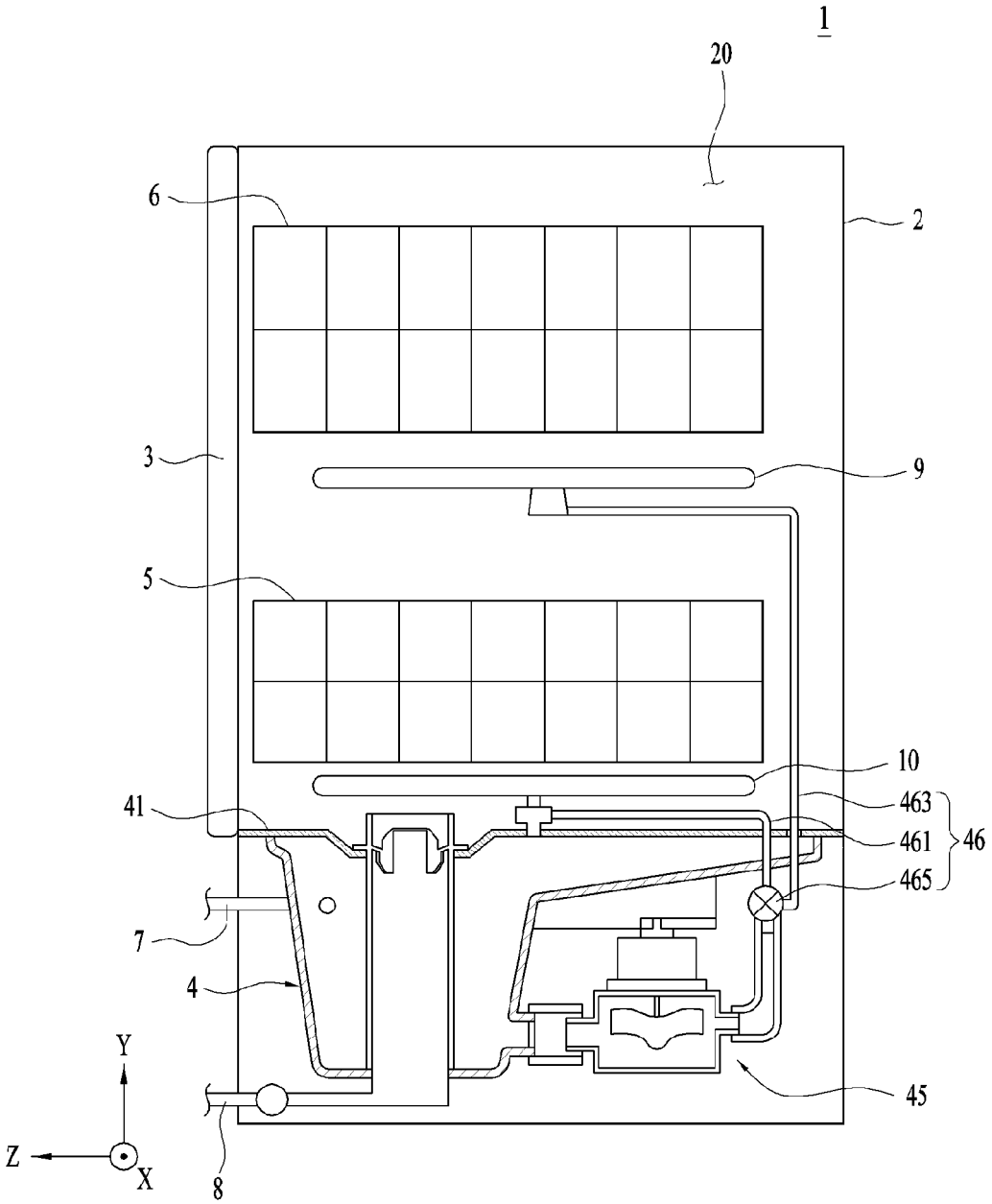
FIG. 9 is a cross-sectional view illustrating the dishwasher of FIG. 1 according to an embodiment.

FIG. 9 is a cross-sectional view illustrating the dishwasher of FIG. 1 according to an embodiment. FIG. 10 is a view illustrating a state in which the first and second accommodating units are unloaded from the dishwasher of FIG. 9 according to an embodiment.

Figure 10:
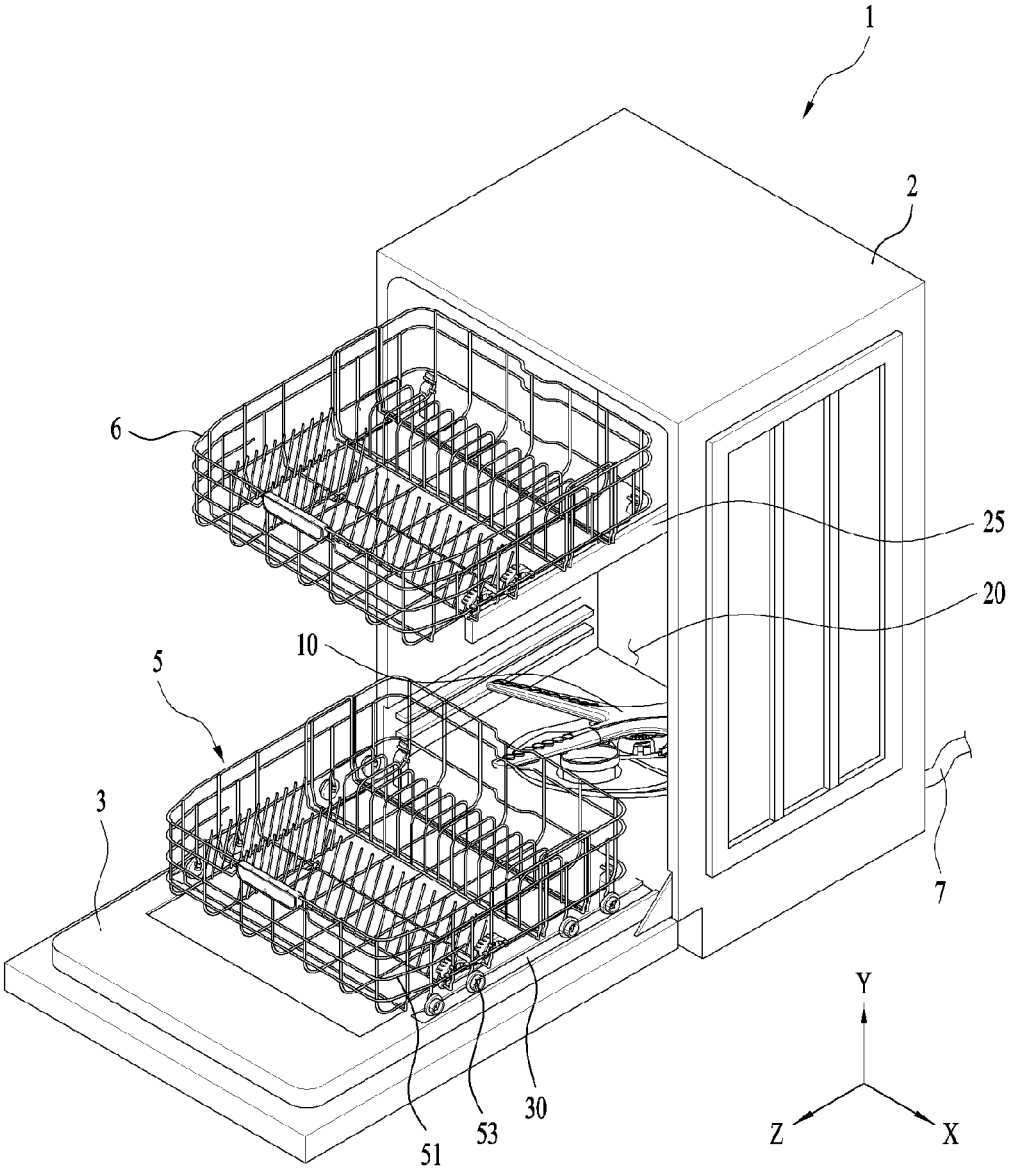
FIG. 10 is a view illustrating a state in which first and second accommodating units are unloaded from the dishwasher of FIG. 9 according to an embodiment.

Referring to FIGS. 1, 9 and 10, at least one accommodating unit 5, 6 may be provided inside of the tub 2 of the dishwasher 1 in order to accommodate the washing object therein. Although FIG. 9 illustrates the dishwasher 1 having two accommodating units, embodiments are not limited thereto. For example, the dishwasher 1 may include three or more accommodating units. Hereinafter, for convenience of description, only a case where the dishwasher 1 includes two accommodating units will be described.

The first accommodating unit 5 may be provided above the sump 4 and may accommodate washing objects therein. Since the lower spray arm assembly 10 is provided under the first accommodating unit 5, the wash water sprayed from the lower spray arm assembly 10 may be supplied to the washing object accommodated in the first accommodating unit 5.

The second accommodating unit 6 may be provided above the first accommodating unit 5 and may accommodate washing objects therein. An upper spray arm assembly 9 may be provided under the second accommodating unit 6, and wash water sprayed from the upper spray arm assembly 9 may be supplied to the second accommodating unit 6.

The water supply unit 7 may be connected to an external water source (not illustrated) and may supply water to the sump 4. The sump 4 may supply the water stored therein to the lower spray arm assembly 10 and the upper spray arm assembly 9 through a supply unit or pump 45 and a supply flow path 46.

The supply unit 45 may include, for example, an impeller and a motor configured to rotate the impeller. The supply flow path 46 may include a first supply flow path 461 connected to the lower spray arm assembly 10, a second supply flow path 463 connected to the upper spray arm assembly 9, and a switching valve 465 configured to selectively open and close the respective supply flow paths 461 and 463. The wash water sprayed through the lower spray arm assembly 10 and the upper spray arm assembly 9 may fall down and be recollected in the sump 4. The sump 4 may store the recollected wash water and may discharge the wash water outward via a drain unit (or drain) 8.

The first accommodating unit 5 may include multiple frames 51, which intersect each other to define the space in which the washing object is seated, and at least two moving rollers 53 provided underneath the frames 51. The moving rollers 53 may include a first moving roller 531 and a second moving roller 533 provided underneath one side of the first accommodating unit 5. The first moving roller 531 may be provided at a foremost position in a Z-axis direction among multiple moving rollers, and the second moving roller 533 may be immediately behind the first moving roller 531.

As illustrated in FIG. 10, when the door 3 is completely opened, the moving rollers 53 may move along the door rail 30, which may be formed on the inner surface of the door 3. In other words, when the first accommodating unit 5 is unloaded or pulled out, the door 3 may support the first accommodating unit 5, and the door rail 30 may guide the movement of the first accommodating unit 5.

The movement of the first accommodating unit 5 within the tub 2 will be described below with reference to FIGS. 11A to 11C hereinafter.

Similar to the first accommodating unit 5, the second accommodating unit 6 may include multiple frames, which define the space in which washing objects may be seated, and at least two rollers provided underneath the frames. In addition, a guide unit or rail 25 may be provided on the inner sidewall 21 of the tub 2 and may support the rollers and guide movement of the rollers. The rollers may move along the guide unit 25, thereby being removed from the tub 2.

Although the first accommodating unit 5 may be supported by the door 3 at the outside of the tub 2, the second accommodating unit 6 may not be supported by the door 3. Thus, the guide unit 25 may be configured so as to be unloaded or pulled, along with the second accommodating unit 6, outward from the tub 2 in order to support the second accommodating unit 6. For example, the guide unit 25 may be a multistage sliding rail.

Hereinafter, the movement of the first accommodating unit 5 within the tub 2 will be described with reference to FIGS. 11A to 11C.

Figure 11A:
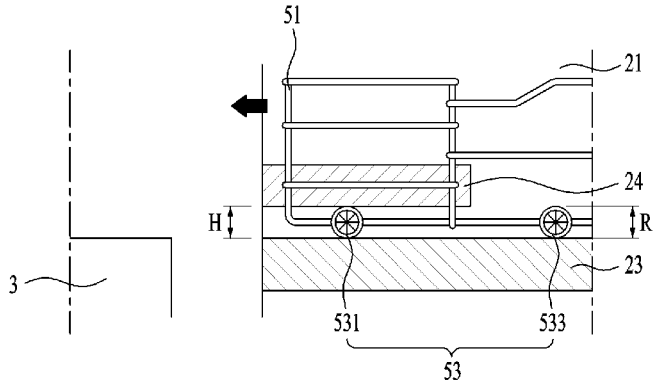
FIGS. 11A to 11C are partial cross-sectional views illustrating a procedure of unloading the first accommodating unit according to an embodiment.
Figure 11B:
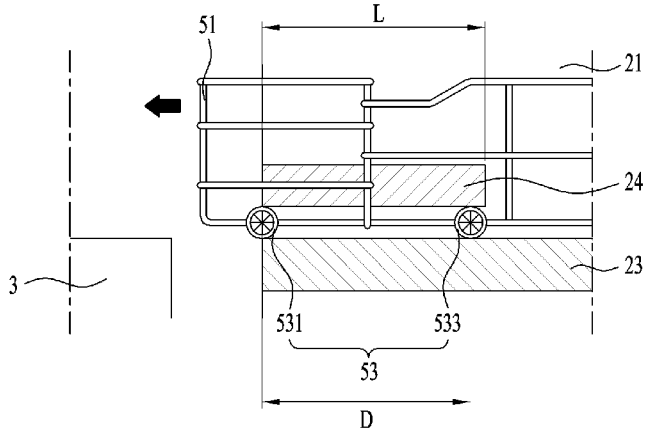
Figure 11C:
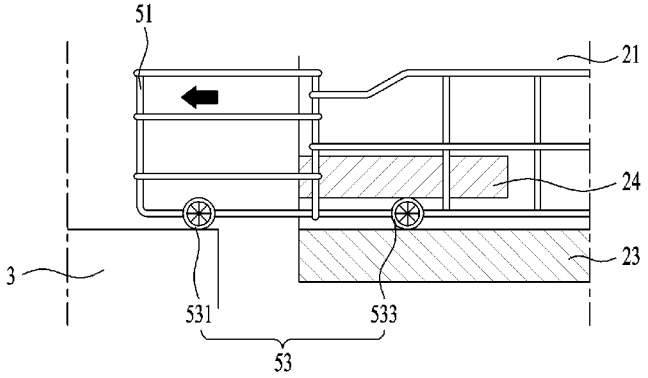

FIGS. 11A to 11C are partial cross-sectional views illustrating a procedure of unloading the first accommodating unit according to an embodiment. At this time, FIGS. 11A to 11C illustrate the process of unloading the first accommodating unit 5 in a temporal sequence.

Referring to FIGS. 11A-11C, the inner sidewall 21 of the tub 2 may include the first and second protrusions 23 and 24, which guide the moving rollers 53. The first and second protrusions 23 and 24 may protrude from the inner sidewall 21 of the tub 2 toward the washing space 20. The moving rollers 53 may move between the first protrusion 23 and the second protrusion 24. A distance H in a Y-axis direction between the first protrusion 23 and the second protrusion 24 may be at least equal to or greater than a diameter R of the moving roller 53. The first protrusion 23 may support a lower surface of the moving roller 53 and guide movement of the moving roller 53.

In order to allow the first accommodating unit 5 to smoothly move from the inside of the tub 2 to the inner surface of the door 3, the first protrusion 23 may extend to a position as close as possible to the door 3. This is because the first accommodating unit 5 may rattle, or in a worst case, the moving roller 53 may not move to the inner surface of the door 3 when the gap between the first protrusion 23 and the door 3 is large. Therefore, as illustrated in FIG. 11A, the first protrusion 23 may extend from the open side of the tub 2 toward the inside of the tub 2.

A distance between the tub 2 and the door 3 may be reduced to a maximum extent, and thus, the first accommodating unit 5 may smoothly move from the inside of the tub 2 to the inner surface of the door 3. In order to allow the first accommodating unit 5 to smoothly move to the inner surface of the door 3, in a state in which the door 3 is completely opened, the upper surface of the first protrusion 23 may be located in a same plane as the inner surface of the door 3.

The first accommodating unit 5 may be pulled forward to thereby be unloaded outward from the tub 2. The user may pull the first accommodating unit 5 from a lateral side or upper side of the first accommodating unit 5. In other words, a force applied to the first accommodating unit 5 by the user may include an X-axis force component and a Y-axis force component. The first accommodating unit 5 may thus be lifted upward (in the Y-axis direction), or may be deviated laterally (in the X-axis direction), and the moving roller 53 may not be seated on the door rail 30, which is formed on the inner surface of the door 3.

The second protrusion 24 may suppress the movement of the moving roller 53 in the Y-axis direction, thereby preventing the first accommodating unit 5 from being lifted upward (in the Y-axis direction) even if the user applies force upward or laterally. In order to prevent the first accommodating unit 5 from being lifted upward, at least one roller among the multiple moving rollers 53 needs to be constrained by the second protrusion 24.

In other words, as illustrated in FIG. 11B, the second protrusion 24 needs to be located above the second moving roller 533 when the first moving roller 531 is unloaded outward from the tub 2, in order to prevent the first accommodating unit 5 from being lifted upward. Accordingly, a length L of the second protrusion 24 may be at least equal to or greater than a distance D between the first and second moving rollers 531 and 533.

In order to allow the moving roller 53 to smoothly move from the inside of the tub 2 to the inner surface of the door 3, the first protrusion 23 may extend from the open side of the tub 2 to the inside of the tub 2. However, since the second protrusion 24 may prevent the moving roller 53 from being lifted upward, it may be unnecessary for the second protrusion 24 to extend from the open side of the tub 2 to the inside of the tub 2. The second protrusion 24 may simply be longer than the distance D between the first moving roller 531 and the second moving roller 533. However, since the first moving roller 531 is defined as a moving roller provided at the foremost position in the Z-axis direction, the second protrusion 24 may also be formed close to the open side of the tub 2.

Figure 12A:
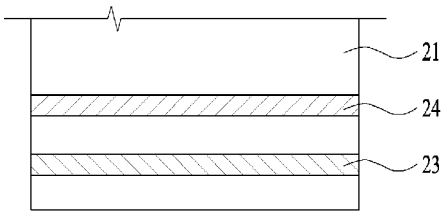
FIGS. 12A to 12C are side views illustrating a first protrusion and a second protrusion.
Figure 12B:
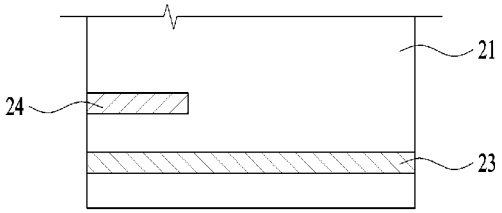
Figure 12C:
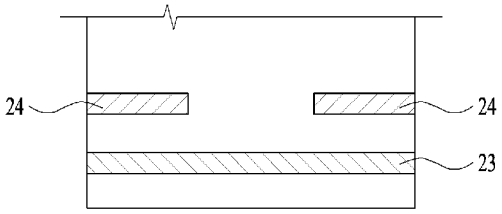

FIGS. 12A to 12C are side views illustrating the first protrusion 23 and the second protrusion 24. In FIGS. 12A to 12C, in order to compare lengths of the first protrusion 23 and the second protrusion 24 with each other, only the inner sidewall 21 of the tub 2, the first protrusion 23, and the second protrusion 24 are illustrated in brief.

Referring to FIG. 12A, the first protrusion 23 and the second protrusion 24 may have a same length. In this case, the protrusions 23 and 24 may be more easily formed on the inner sidewall 21 of the tub 2, which may improve aesthetics.

Alternatively, the first protrusion 23 and the second protrusion 24 may have different lengths. For example, as illustrated in FIG. 12B, the first protrusion 23 may extend to the rear wall of the tub 2 along the inner sidewall 21 of the tub 2, and the second protrusion 24 may have a length that is greater than a distance D between the first moving roller 531 and the second moving roller 533. In addition, as illustrated in FIG. 12C, a plurality of the second protrusion 24 may be provided on the inner sidewall 21 of the tub 2.

As described above, according to the embodiments, the dish washer 1 may prevent the first accommodating unit 5 from being lifted upward regardless of the direction in which the user pulls the first accommodating unit 5, and the first accommodating unit 5 may be smoothly seated on the door rail 30 formed on the door 3. Thereby, user satisfaction with products may be increased.

Accordingly, the embodiments are directed to a dishwasher that substantially obviates one or more problems due to limitations and disadvantages of the related art. Embodiments disclosed herein provide a dishwasher, that may include a main arm configured to rotate inside of a tub and an auxiliary arm mounted to the main arm so as to perform rolling. Embodiments further provide a dishwasher, which may allow an accommodating unit to be smoothly unloaded along a rail formed on a door regardless of a direction in which the accommodating unit is pulled.

Additional advantages, objects, and features will be set forth in part in the description and in part will become apparent to those having ordinary skill in the art upon examination of the embodiments or may be learned from practice. The objectives and other advantages may be realized and attained by the structure particularly pointed out in the written description and claims hereof as well as the appended drawings.

Embodiments disclosed herein provide a dishwasher that may include a tub configured to define a washing space in which a washing object is washed, the tub having an open side, a first accommodating unit or rack configured to accommodate the washing object inside of the tub, the first accommodating unit being unloadable from the tub, and a door configured to selectively open and close the open side of the tub, the door supporting the first accommodating unit when the first accommodating unit is unloaded. The tub may include a first protrusion configured to protrude from an inner sidewall of the tub toward the washing space so as to support the first accommodating unit and guide movement of the first accommodating unit, and a second protrusion provided above the first protrusion and configured to protrude from the inner sidewall of the tub toward the washing space so as to prevent the first accommodating unit from being lifted upward when the first accommodating unit is unloaded.

The first protrusion may have an upper surface located in a same plane as an inner surface of the door when the door is completely opened. The second protrusion may extend from the open side of the tub toward an inside of the tub.

The first accommodating unit may include a plurality of frames configured to intersect each other so as to define a seating space of the washing object, and at least two moving rollers provided underneath the frames. A distance between the first protrusion and the second protrusion may be greater than a diameter of the moving rollers.

The moving rollers may include a first moving roller and a second moving roller sequentially provided from a front side of the first accommodating unit, and the second protrusion may have a length greater than a distance between the first and second moving rollers. The dishwasher may further include a second accommodating unit or rack provided above the first accommodating unit and configured to accommodate the washing object inside of the tub, the second accommodating unit being unloadable from the tub.

The dishwasher may further include a guide unit or rail provided on the inner sidewall of the tub so as to support the second accommodating unit and guide movement of the second accommodating unit, and the guide unit may be unloaded along with the second accommodating unit. According to exemplary embodiments, a dish washer may prevent an accommodating unit from being lifted upward regardless of a direction in which the user pulls the accommodating unit. Thereby, the accommodating unit may be smoothly unloaded along a rail formed on a door, which may increase user satisfaction with products.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

a tub configured to define a washing space and having an open side;

a door configured to selectively open and close the open side of the tub;

a sump provided in the tub and having a sump cover; and a spray arm assembly affixed to the sump cover and configured to spray water inside of the washing space, the spray arm assembly including;

an arm holder rotatably attached to the sump cover along a first axis;

a fixed gear mounted on the sump cover and surrounding the arm holder;

at least one main arm connected to the arm holder and including a gear rotational shaft;

at least one auxiliary arm connected to the arm holder;

a link bracket connected to the at least one main arm and the at least one auxiliary arm; and an eccentric rotational gear rotatably attached to the gear rotational shaft, wherein the eccentric rotational gear rotates around the fixed gear when the arm holder rotates.

2. The dishwasher of claim 1, wherein the eccentric rotational gear includes an eccentric boss offset from a center of the eccentric rotational gear, and wherein the eccentric boss alters a position of the link bracket as the eccentric rotational gear rotates.

3. The dishwasher of claim 1 wherein a number of first gear teeth on the fixed gear and a number of second gear teeth on the eccentric rotational gear are co-prime integers.

4. The dishwasher of claim 2, wherein the at least one auxiliary arm includes a power transmission tab configured to be engaged with the link bracket such that when the link bracket is moved by the eccentric rotational gear, the power transmission tab rotates the at least one auxiliary arm about a second axis perpendicular to the first axis.

5. The dishwasher of claim 2, wherein the link bracket includes an insertion hole into which the eccentric boss may be inserted, and a coupling portion into which the power transmission tab may be inserted.

6. The dishwasher of claim 1, further including a flow path switching valve attached to the spray arm assembly and configured to vary a direction in which water is supplied to the spray arm assembly.

7. The dishwasher of claim 1, wherein the fixed gear further includes a hand guard extending axially from a circumferential portion of the fixed gear.

8. The dishwasher of claim 1, wherein the at least one auxiliary arm further includes a discharge hole at a first end closest to the arm holder, wherein foreign materials in the spray arm assembly are released prior to entering the at least one auxiliary arm.

9. The dishwasher of claim 1, wherein the tub includes:

a first protrusion protruding from an inner sidewall of the tub toward the washing space so as to support a first accommodating rack and guide a movement of the first accommodating rack; and a second protrusion provided above the first protrusion and protruding from the inner sidewall of the tub toward the washing space so as to prevent the first accommodating rack from being lifted upward when the first accommodating rack is unloaded.

10. The dishwasher of claim 9, wherein the first accommodating rack includes at least two moving rollers, and wherein a distance between the first protrusion and the second protrusion is greater than a diameter of the at least two moving rollers.

11. The dishwasher of claim 10, further including a second accommodating rack having a guide rail attached to an inner side of the tub, wherein the guide rail is configured to be unloaded from the tub along with the second accommodating rack.

12. A dishwasher comprising:

a tub configured to define a washing space and having an open side;

a first accommodating rack configured to accommodate a washing object inside the tub, the first accommodating rack being unloadable from the tub;

a door configured to selectively open and close the open side of the tub, the door supporting the first accommodating rack when the first accommodating rack is unloaded;

a sump provided in the tub and having a sump cover; and a spray arm assembly affixed to the sump cover and configured to spray water inside the washing space, the spray arm assembly including;

an arm holder rotatably attached to the sump cover along a first axis;

a fixed gear mounted on the sump cover and surrounding the arm holder;

at least one main arm connected to the arm holder and including a gear rotating shaft;

at least one auxiliary arm connected to the arm holder;

a link bracket connected to the at least one main arm and the at least one auxiliary arm; and an eccentric rotation gear rotatably attached to the gear rotating shaft, wherein the eccentric rotation gear rotates around the fixed gear when the arm holder rotates, and wherein the tub includes:

a first protrusion protruding from an inner sidewall of the tub toward the washing space so as to support the first accommodating rack and guide a movement of the first accommodating rack; and a second protrusion provided above the first protrusion and protruding from the inner sidewall of the tub toward the washing space so as to prevent the first accommodating rack from being lifted upward when the first accommodating rack is unloaded.

* * * * *